US006809272B2

(12) United States Patent
Yamada

(10) Patent No.: US 6,809,272 B2
(45) Date of Patent: Oct. 26, 2004

(54) DOUBLE ACTION PUSH SWITCH

(75) Inventor: Kazunori Yamada, Tokyo (JP)

(73) Assignee: SMK Corporation, Tokyo (JP)

( * ) Notice: Subject to any disclaimer, the term of this patent is extended or adjusted under 35 U.S.C. 154(b) by 23 days.

(21) Appl. No.: 10/612,038

(22) Filed: Jul. 1, 2003

(65) Prior Publication Data

US 2004/0099519 A1 May 27, 2004

(30) Foreign Application Priority Data

Oct. 22, 2002 (JP) ..... 2002-306794

(51) Int. Cl.[7] ..... H01H 13/64
(52) U.S. Cl. ..... 200/1 B; 200/406; 200/341
(58) Field of Search ..... 200/1 B, 16 R, 200/16 D, 406, 520, 292, 341

(56) References Cited

U.S. PATENT DOCUMENTS 5,430,261 A * 7/1995 Malone ..... 200/1 B
5,719,361 A * 2/1998 Lee ..... 200/1 B
5,796,056 A * 8/1998 Bredow et al. ..... 200/5 A
5,834,716 A * 11/1998 Lee ..... 200/5 R
6,303,887 B1 * 10/2001 Ando ..... 200/512
6,489,580 B2 * 12/2002 Yanai et al. ..... 200/406
6,603,086 B2 * 8/2003 Kawaguchi et al. ..... 200/517

FOREIGN PATENT DOCUMENTS

JP 2002-186830 6/2002

* cited by examiner

*Primary Examiner*—Michael A. Friedhofer
(74) *Attorney, Agent, or Firm*—Darby & Darby

(57) ABSTRACT

The double action push switch has a longer life and more design freedom for attaining desired load characteristics for first and second switching actions so that it occupies less area on a printed circuit board. Two plate members are housed side-by-side in a cavity of the push switch. An operating portion of a key top is positioned so that P3≠P4, where P3 and P4 are the respective operating loads applied to the operating portion when one or the other of two pressing points act as the fulcrum and moments on the key top are balanced. The operating portion is positioned offset from a center vertical axis of the key top if both plate members have the same load characteristics. Thus, a first pressing force inverts one plate member for a first electrical connection, and the next pressing force inverts the other plate member for a second electrical connection.

20 Claims, 19 Drawing Sheets

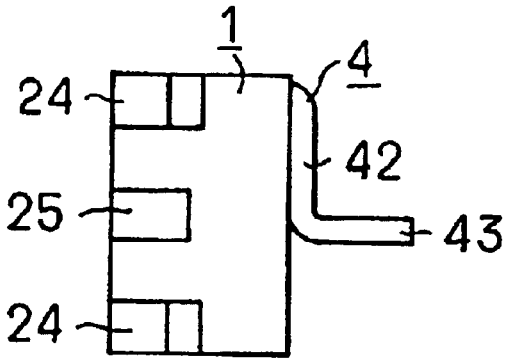
FIG. 7
FIG. 8A
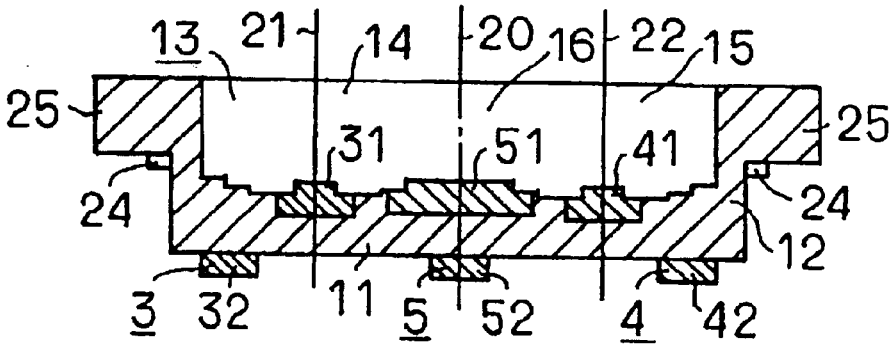
FIG. 8B
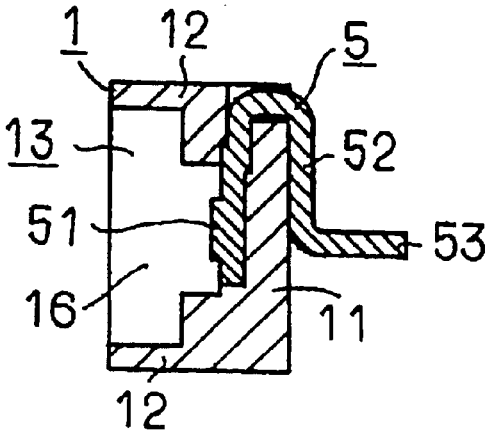

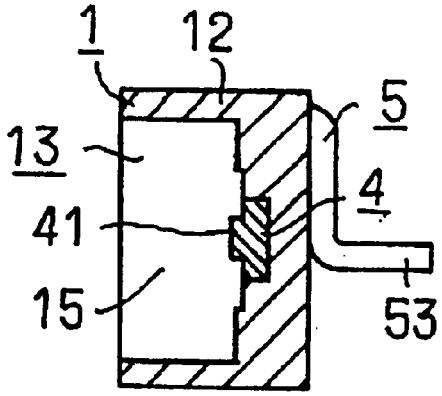
FIG. 8C
FIG. 9A
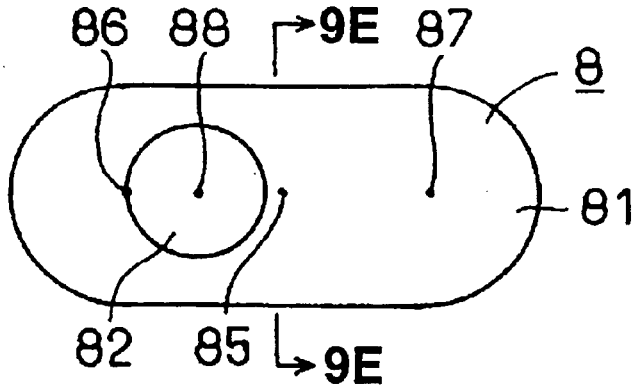
FIG. 9B
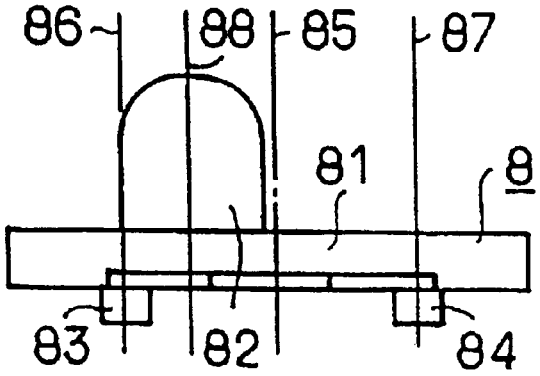

FIG. 9C
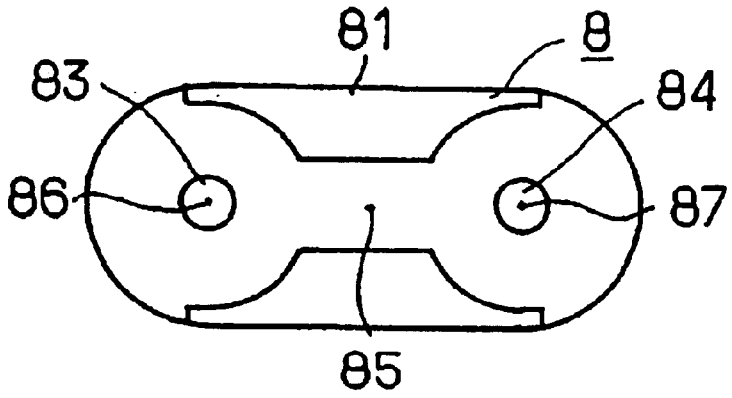
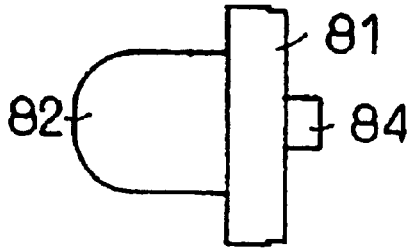
FIG. 9D
FIG. 9E
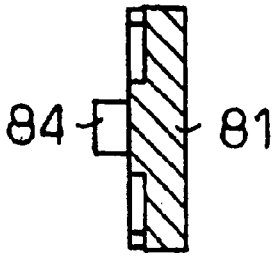

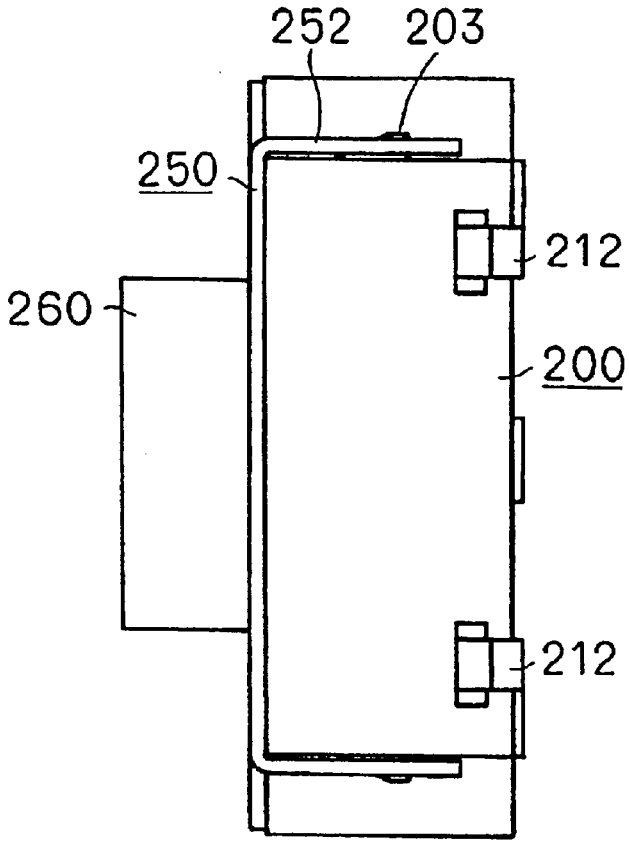
FIG. 15
PRIOR ART
FIG. 16
PRIOR ART
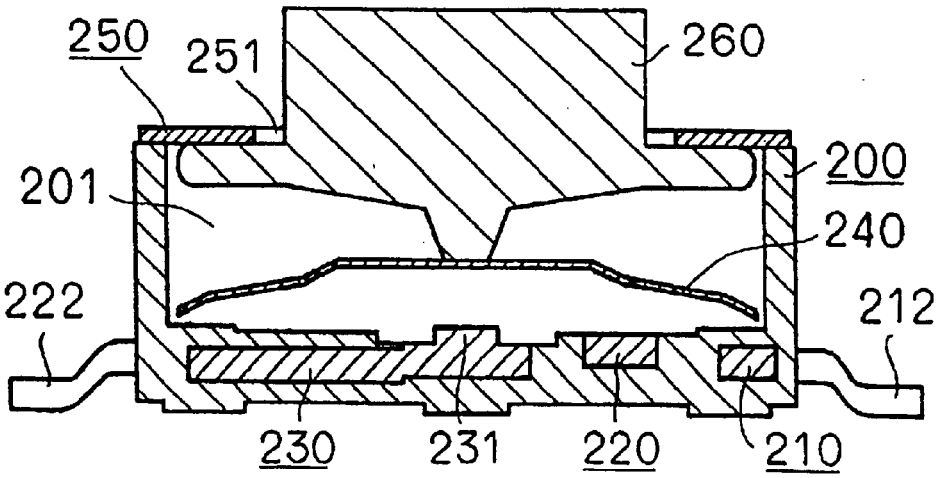

FIG. 22A
PRIOR ART
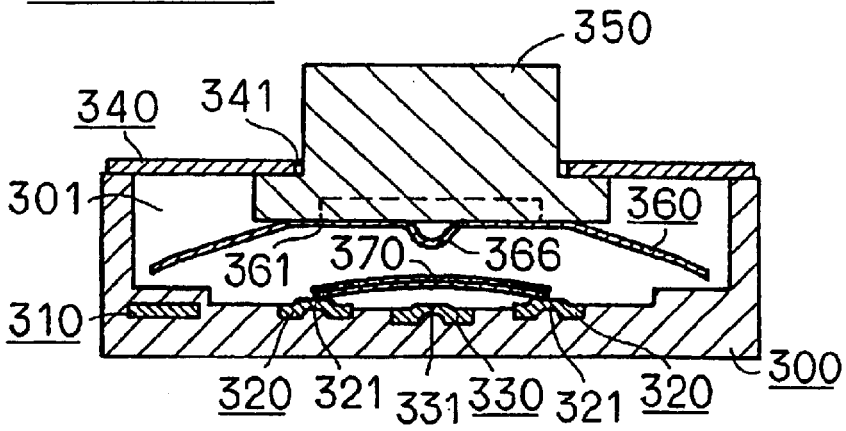
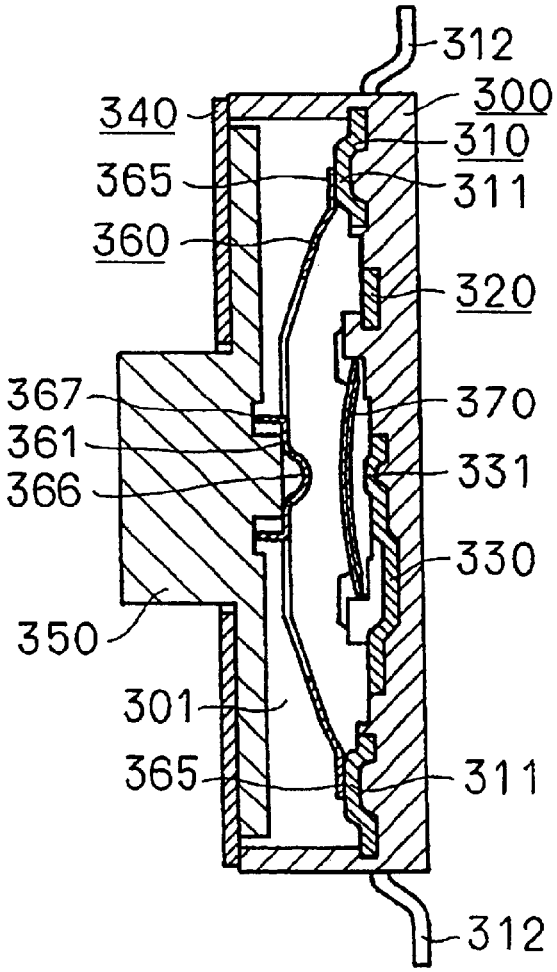
FIG. 22B
PRIOR ART

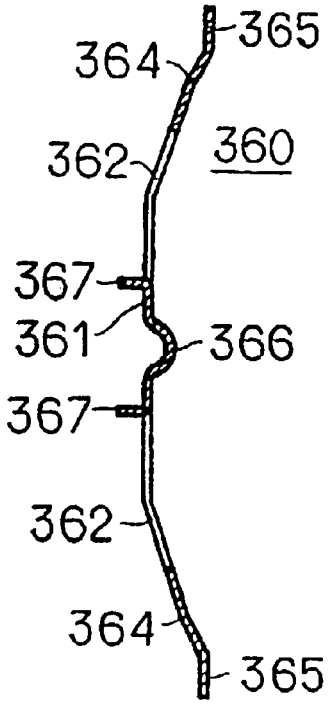
FIG. 27A
PRIOR ART
FIG. 27B
PRIOR ART
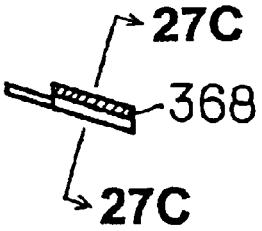
FIG. 27C
PRIOR ART
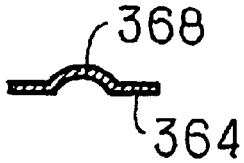

DOUBLE ACTION PUSH SWITCH

BACKGROUND OF THE INVENTION

1. Field of the Invention

The present invention relates to a double action push switch incorporated in cameras or electronic devices such as mobile phones. More particularly, it relates to a double action push switch used as the shutter release button of a mobile camera phone.

2. Description of the Related Art

FIG. 13 to FIG. 19B illustrate one known double action push switch.

A plate member 240 is accommodated in a cavity 201 formed in a housing 200. First, second, and third terminals 210, 220, 230 are fixed on the bottom plate of the housing 200, and their respective connecting portions 212, 222, 232 are protruded outside of the housing 200.

The open end of the cavity 201 is closed by a cover 250, which has a hole 251 at its center, through which an operating portion of a key top 260 protrudes to the outside. The cover 250 is fixed to the housing 200 by locking springs 252 formed on a side face of the cover 250, which engage with locking protrusions 203 protruded on an outer face of the housing 200.

As shown in FIGS. 19A and 19B, the plate member 240 consists of a domed center contact portion 241, an annular portion 244 around the center contact portion 241 separated therefrom by a pair of semi-circular arc holes 242 but continued therewith by a pair of coupling portions 243, and parallel rectangular plate-like peripheral contact portions 245 opposite each other on the outer periphery of the annular portion 244. The annular portion 244 is slanted downward from inside to outside and formed with wrinkles 246 at circumferentially equally spaced locations, each being offset by 90°.

The plate member 240 is initially in a resiliently deformed state inside the cavity 201 as it is held between an inner bottom face of the housing 200 and a lower face of the key top 260, as shown in FIG. 16 and FIG. 17. Its peripheral contact portions 245 are in contact with the contact points 211 of the first terminal 210.

When the key top 260 is pushed down, its pressing protrusion presses the center contact portion 241 of the plate member 240, inverting the annular portion 244. This first deformation causes the periphery of the center contact portion 241 to touch the contact points 221 of the second terminal 220, thereby establishing an electrical connection between the first and second terminals 210, 220.

When the key top 260 is pushed further down, its pressing protrusion presses the center contact portion 241 of the plate member 240 to cause further deformation. This second deformation causes the center of the center contact portion 241 to touch the contact point 231 of the third terminal 230, thereby establishing electrical connection between the first, second, and third terminals 210, 220, 230.

Since the prior art shown in FIG. 13 to FIG. 19B performs the two step connection with one plate member 240, the coupling portions 243 of the plate member 240 are subjected to too much stress, because of which the plate member 240 tends to break with fewer number of operation cycles.

Because the first deformation of the plate member 240 causes an inversion of the annular portion 244 which is formed by a bending process, and the second deformation causes inversion of the center contact portion 241 which is formed by a drawing process, stress is concentrated on the coupling portions 243, which connect the annular portion 244 and center contact portion 241. The coupling portions 243 are therefore particularly susceptible to cracks.

Another problem with the two step connection with one plate member 240 was that there was little freedom in setting different load characteristics for the first connection and the second connection.

That is, if the switch is designed to have desired load characteristics in the action of the first connection, then it inevitably has limitations in providing desired load characteristics for the action of the second connection.

The present inventors have designed a double action push switch as shown in Japanese Patent Application No. 2002-186830 that can resolve the above problems; FIG. 20 to FIG. 27C illustrate this push switch.

The housing 300 is formed with a cavity 301, and first, second, and third terminals 310, 320, 330 are fixed in the housing 300. Their respective contact points 311, 321, 331 are exposed in the inner bottom face of the cavity 301 on the outer side, inner side, and at the center, and their respective connecting portions 312, 322, 332 are protruded outside of the housing 300.

The open end of the cavity 301 is closed by a cover 340, which has a hole 341 at its center, through which an operating portion of a key top 350 protrudes to the outside. The cover 340 is fixed to the housing 300 by locking springs 342 formed on a side face of the cover 340 engaging with locking protrusion 303 protruded on an outer face of the housing 300.

The plate member accommodated inside the cavity 301 consists of first and second plates 360, 370 spaced apart in the up and down direction.

As shown in FIG. 25 to FIG. 27C, the first plate 360 is made up of a rectangular plate-like center contact portion 361, an annular portion 364 around the center contact portion 361 spaced away therefrom by a pair of semi-circular holes 362 and linked thereto by strips of coupling portions 363, and a pair of peripheral contact portions 365 on the outer periphery of the annular portion 364 at opposite locations. The center contact portion 361 has a downward protrusion 366 at its center and reinforcing upright portions 367 along the end edges of lengthwise direction. The annular portion 364 is formed with wrinkles 368 at circumferentially equally spaced locations.

The second plate 370 consists of two superposed pieces placed inside the cavity 301 as shown in FIGS. 22A and 22B, and has a dome-like shape protruding upwards.

When the key top 350 is pushed down, its pressing portion presses the center contact portion 361 of the first plate 360, inverting the coupling portions 363 as well as causing resilient deformation of the annular portion 364. This first deformation causes the protrusion 366 on the first plate 360 to touch the center of the second plate 370, whereby electrical connection is established between the first and second terminals 310, 320.

When the key top 350 is pushed further down, the protrusion 366 on the first plate 360 presses the center of the second plate 370 and causes it to invert. This second deformation causes the center of the second plate 370 to touch the contact point 331 of the third terminal 330, whereby electrical connection is achieved between the first, second, and third terminals 310, 320, 330.

Because the plate member consists of two plates 360, 370, both of them are not subjected to excessive stress. The plate member therefore has a longer life than the prior art with a single plate member. Also, this double action push switch can have a wider range of variations in its load characteristics because it has more freedom in designing the switch to attain desired load characteristics for each of the first and second switching actions.

The construction shown in FIG. 20 to FIG. 27C, however, has a problem that it occupies a relatively large mounting area on a printed circuit board because of large outer dimensions of the first plate 360.

More specifically, when the annular portion 364 of the first plate 360 has an outer diameter of 5.5 mm, and the second plate 370 has an outer diameter of 2.3 mm, the housing 300 has outer dimensions of 7.8 mm×5.7 mm, measured in the top plan view of FIG. 20.

The prior art shown in FIG. 13 to FIG. 19B also has the problem of large mounting area on a printed circuit board because of large outer dimensions of the plate member 240 which performs the two step connecting action.

SUMMARY OF THE INVENTION

The present invention has been devised in view of the above problems, and an object of the invention is to provide a double action push switch having a longer life and more freedom in design to attain desired load characteristics for each step of switching actions and a smaller size so that it occupies less area on a printed circuit board.

A double action push switch according to an aspect of the present invention includes: a housing (1) formed with a cavity (13) therein; a first terminal (3), a second terminal (4), and a third terminal (5) fixed in the housing (1), respectively having contact points (31, 41, 51) exposed in an inner bottom face of the cavity (13); a first plate member (6) and a second plate member (7) placed side by side inside the cavity (13), both having a domed shape with their centers bulging away from the inner bottom face of the cavity (13), the first plate member (6) having its center and peripheral portion respectively abutting the contact points (31, 51) of the first and third terminals (3, 5), and the second plate member (7) having its center and peripheral portion abutting the contact points (41, 51) of the second and third terminals (4, 5); and a key top (8) having an operating portion (82) which is pressed for a double action switching operation and a first pressing portion (83) and a second pressing portion (84) for respectively pressing the centers of the first and second plate members (6, 7) for causing inversion thereof, the operating portion (82) being positioned at such a location that an operating load (P3) on the operating portion when a pressing point (K1) of the first pressing portion (83) on the first plate member (6) is a fulcrum and moments on the key top (8) are balanced is not equal to an operating load (P4) on the operating portion when a pressing point (K2) of the second pressing portion (84) on the second plate member (7) is a fulcrum and moments on the key top (8) are balanced. In this double action push switch configured above, a first pressing force applied to the operating portion (82) causes inversion of the center of one of the first plate member (6) and the second plate member (7) for achieving first electrical connection, and a second pressing force applied to the operating portion (82) causes inversion of the center of the other one of the first plate member (6) and the second plate member (7) for achieving second electrical connection.

With this configuration, when a pressing force is applied to the operating portion (82) of the key top (8), the first and second pressing portions (83, 84) of the key top (8) press the centers of the first and second plate members (6, 7) one after another and cause inversion of their centers.

Because the location of the operating portion (82) on the key top (8) is determined so that the operating load when one pressing point is the fulcrum is not equal to the operating load when the other pressing point is the fulcrum (P3 is not equal to P4), the pressing force first applied to the operating portion (82) causes inversion of the center of one of the first and second plate members (6, 7) so that it makes contact with two of the contact points (31, 41, 51) for achieving first electrical connection. The pressing force applied next to the operating portion (82) causes inversion of the center of the other one of the first and second plate members (6, 7) so that it makes contact with all of the contact points (31, 41, 51) for achieving second electrical connection.

According to another aspect of the invention, the first plate member (6) and the second plate member (7) can be constructed simply by forming them with identical load characteristics, and by setting the point on which the operating loads (P3, P4) are applied at a location offset from a mid point between the pressing points (K1, K2) of the first and second pressing portions on the first and second plate members (6, 7).

Alternatively, according to another aspect of the invention, the first plate member (6) and the second plate member (7) may have different load characteristics, and the point on which the operating loads (P3, P4) are applied may be made to coincide with a mid point between the pressing points (K1, K2) of the first and second pressing portions on the first and second plate members (6, 7). Thereby, the position at which the operating portion (82) is formed can readily be determined.

Alternatively, according to another aspect of the invention, the first plate member (6) and the second plate member (7) may have different load characteristics, and the point on which the operating loads (P3, P4) are applied may be offset from a mid point between the pressing points (K1, K2) of the first and second pressing portions on the first and second plate members (6, 7). Thereby, there will be more freedom in setting respective load characteristics such as clicking feeling for the first and second switching actions.

According to another aspect of the invention, the first, second, and third terminals (3, 4, 5) include respective connecting portions (33, 43, 53) protruding side by side from the housing (1) in a direction substantially the same as a direction in which the operating portion (82) of the key top (8) is pressed, so that the housing (1) is laterally mounted onto the printed circuit board (10), and that the operating portion (82) of the key top (8) is pressed in a direction parallel to the substrate face.

According to another aspect of the invention, the housing (1) includes stoppers (25) which will abut a substrate face at an edge portion of a recess (10*a*) formed in a printed circuit board (10) to which the housing (1) is mounted, so that the housing (1) does not protrude largely from the edge of the printed circuit board (10), and that the mounting of the housing (1) in the recess (10*a*) in the printed circuit board (10) is carried out easily.

A double action push switch according to another aspect of the invention includes: a first push switch (130) and a second push switch (140) mounted side by side on a printed circuit board (110), the first and second push switches (130, 140) respectively including a first key top (132) and a second key top (142), and a first plate member (133) and a second plate member (143) of a domed shape with their centers bulging towards the first and second key tops (132, 142); and an outer key top (150) disposed opposite the first and second key tops (132, 142), including an operating portion (152)

protruded on one side and a first pressing portion (153) and a second pressing portion (154) protruded on the other side thereof, wherein a pressing force applied to the operating portion (152) of the outer key top (150) causes the first and second pressing portions (153, 154) of the outer key top (150) to press the first and second key tops (132, 142), thereby causing inversion of one of the first plate member (133) and the second plate member (143) for achieving first electrical connection, and inversion of the other one of the first plate member (133) and the second plate member (143) for achieving second electrical connection, and the operating portion of the outer key top (150) is positioned at such a location that an operating load (P3) on the operating portion (152) when a pressing point (K1) of the first pressing portion (153) on the first key top (132) is a fulcrum and moments on the outer key top (150) are balanced is not equal to an operating load (P4) on the operating portion (152) when a pressing point (K2) of the second pressing portion (154) on the second key top (142) is a fulcrum and moments on the outer key top (150) are balanced.

With this configuration, when a pressing force is applied to the operating portion (152) of the outer key top (150), the first and second pressing portions (153, 154) of the outer key top (150) press the first and second key tops (132, 142) of the first and second push switches (130, 140), thereby inverting the centers of the first and second plate members (133, 143) of the first and second push switches (130, 140) one after another.

Because the location of the operating portion (152) on the key top (150) is determined so that the operating load when one pressing portion is the fulcrum is not equal to the operating load when the other pressing point is the fulcrum (P3 is not equal to P4), the pressing force first applied to the operating portion (152) causes inversion of the center of one of the first and second plate members (133, 143) for achieving first electrical connection. The pressing force applied next to the operating portion (152) causes inversion of the center of the other one of the first and second plate members (133, 143) for achieving second electrical connection.

According to another aspect of the invention, the first plate member (133) and the second plate member (143) can be constructed simply by forming them with identical load characteristics, and by setting the point on which the operating loads (P3, P4) are applied at a location offset from a mid point between the pressing points (K1, K2) of the first and second pressing portions on the first and second key tops.

Alternatively, according to another aspect of the invention, the first plate member (133) and the second plate member (143) may have different load characteristics, and the point on which the operating loads (P3, P4) are applied may be made to coincide with a mid point between the pressing points (K3, K4) of the first and second pressing portions on the first and second key tops. Thereby, the position at which the operating portion (152) is formed can readily be determined.

Alternatively, according to another aspect of the invention, the first plate member (133) and the second plate member (143) may have different load characteristics, and the point on which the operating loads (P3, P4) are applied may be offset from a mid point between the pressing points (K1, K2) of the first and second pressing portions on the first and second key tops. Thereby, there will be more freedom in setting respective load characteristics such as clicking feeling for the first and second switching actions.

According to another aspect of the invention, the first and second push switches (130, 140) are mounted on the printed circuit board (10) side by side such that the first and second key tops (132, 142) are pressed in a direction parallel to a substrate face of the printed circuit board (10). Thus, the first and second push switches (130, 140) are mounted onto the printed circuit board (10) such that the operating portion (152) of the outer key top (150) is pressed in a direction parallel to the substrate face.

BRIEF DESCRIPTION OF THE DRAWINGS

FIG. 7 is a right side view of FIG. 5;

FIG. 8A to FIG. 8C are cross sections taken along the lines 8A—8A, 8B—8B, and 8C—8C of FIG. 5;

FIG. 9A is a top plan view illustrating the key top 8 shown in FIG. 1A to FIG. 4;

FIG. 9B is a front view of the key top shown in FIG. 1A to FIG. 4;

FIG. 9C is a bottom plan view of the key top shown in FIG. 1A to FIG. 4;

FIG. 9D is a right side view of FIG. 9A;

FIG. 9E is a cross section taken along the line 9E—9E of FIG. 9A;

FIG. 15 is a right side view of FIG. 13;

FIG. 16 is a cross section taken along the line 16—16 of FIG. 13;

FIG. 22A and FIG. 22B are cross sections taken along the lines 22A—22A and 22B—22B of FIG. 20;

FIG. 27A and FIG. 27B are cross sections taken along the lines 27A—27A and 27B—27B of FIG. 25; and FIG. 27C is a cross section taken along the line 27C—27C of FIG. 27B.

DETAILED DESCRIPTION OF THE PREFERRED EMBODIMENTS

Figure 1A:
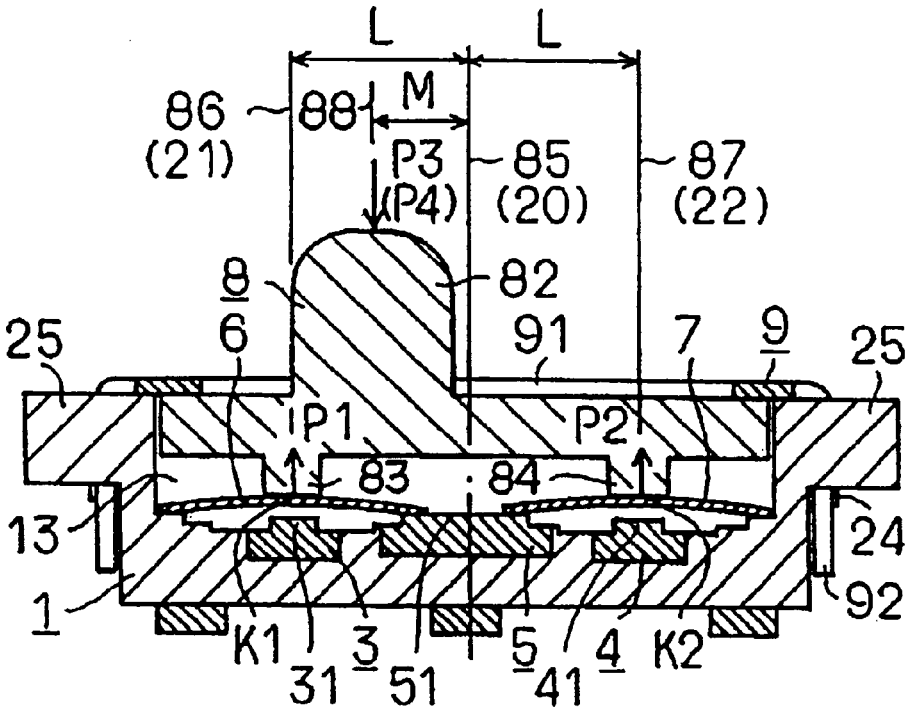
FIG. 1A to FIG. 1C are enlarged cross sections taken along the lines 1A—1A, 1B—1B, and 1C—1C of FIG. 2 illustrating one embodiment of the double action push switch according to the present invention.
Figure 1B:
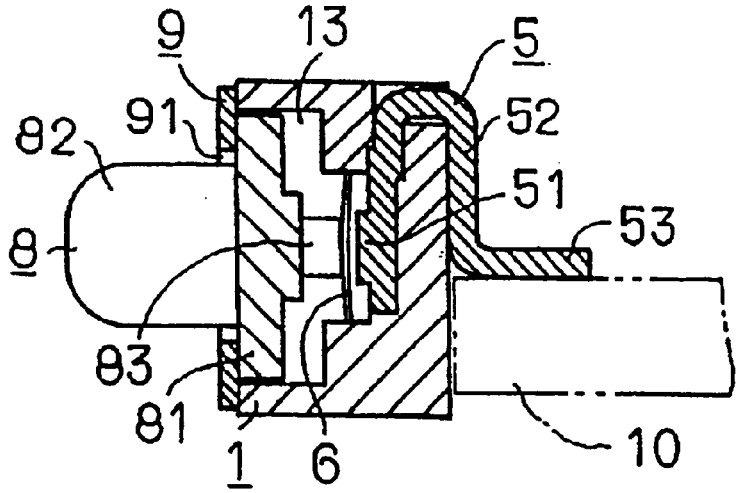
Figure 1C:
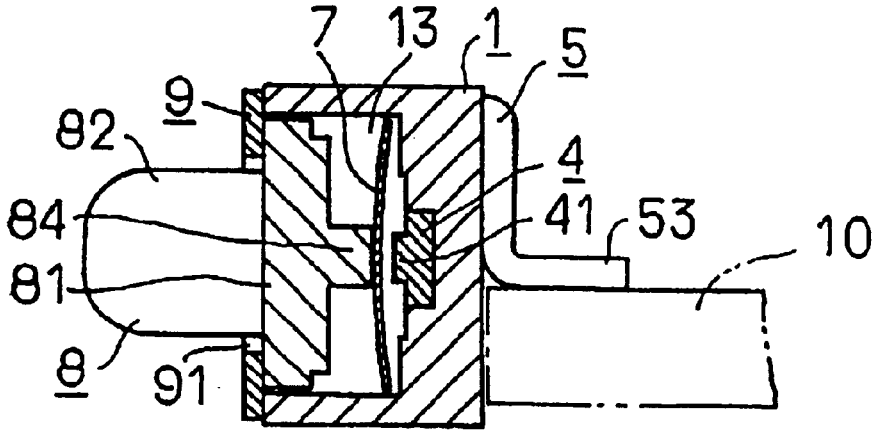
Figure 2:
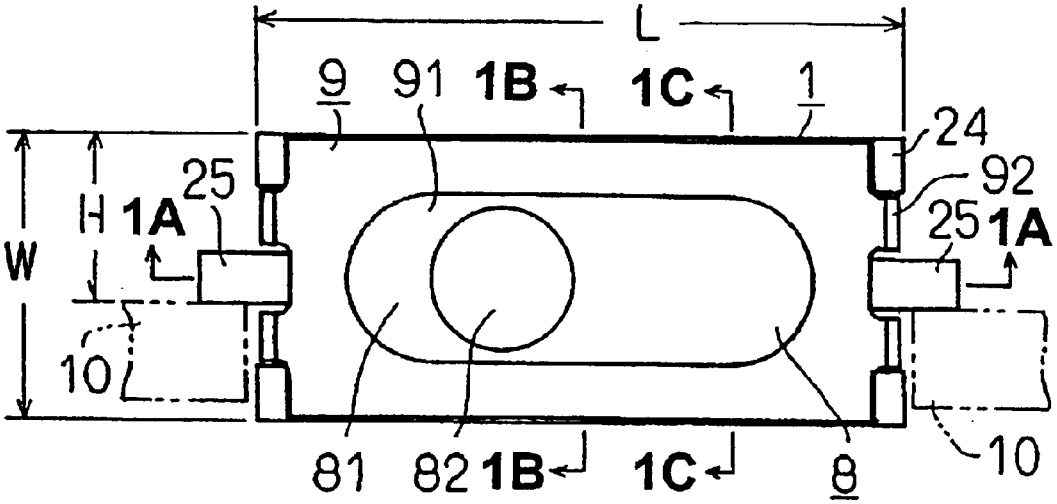
FIG. 2 is a top plan view of one embodiment of the double action push switch according to the present invention.
Figure 3:
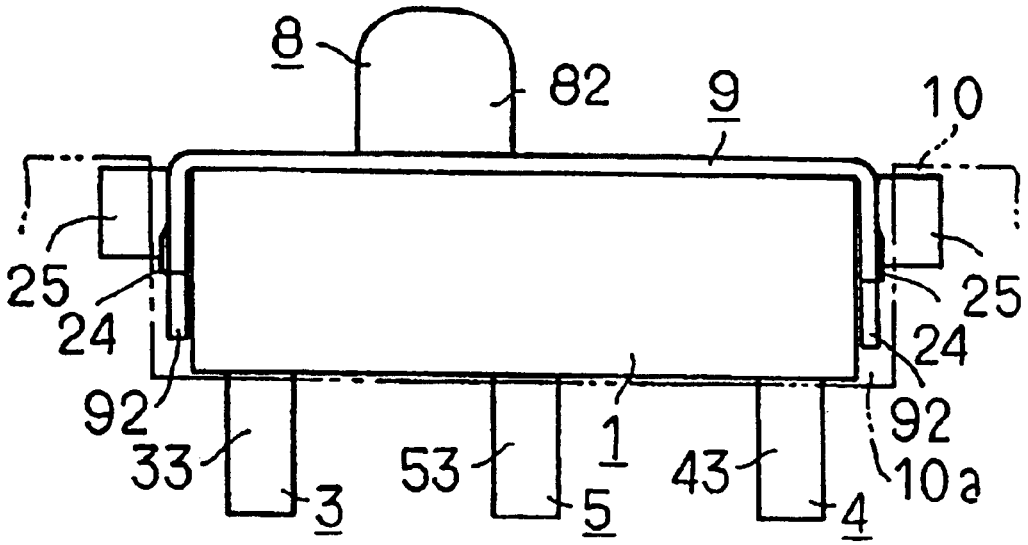
FIG. 3 is a front view of FIG. 2.
Figure 4:
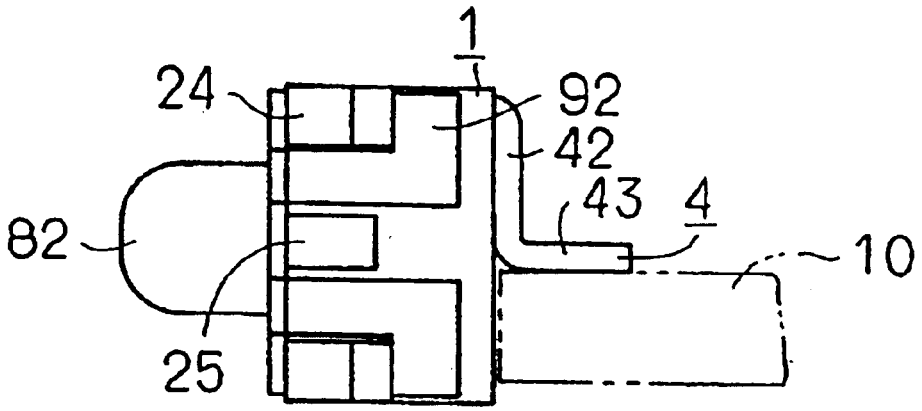
FIG. 4 is a right side view of FIG. 2.

Preferred embodiments of the present invention will be hereinafter described with reference to FIG. 1A to FIG. 12B.

One typical embodiment of the present invention will be first described with reference to FIG. 1A to FIG. 10C.

FIG. 1A to FIG. 4 provide overall views of the present invention. Reference numerals 3, 4, 5 denote first, second, and third terminals, respectively, and 6, 7 represent first and second plate members; numerals 8, 9, 10 respectively indicate a key top, a cover, and a printed circuit board.

Housing 1 is substantially cuboidal and made of an insulating synthetic resin material. As shown in FIG. 5 to FIG. 8C, it consists of a rectangular bottom plate 11 and integrally formed side plates 12 standing upright from all surrounding edges of the bottom plate 11 to form an open top cavity 13 for accommodating plate members. The open top end of the cavity 13 has an oval shape.

The cavity 13 consists of two accommodating recesses 14, 15 for the first and second plate members 6, 7, and a communicating recess 16 lying between the two accommodating recesses.

The inner bottom face of the first accommodating recess 14 includes a circular center and an annular surround continuous with the center. The center is formed slightly lower than the surround. A first step 17 is formed to a portion of the surround on the opposite side from the communicating recess 16 (left side in FIG. 5). A peripheral portion of the first plate member 6 abuts first step 17.

Figure 5:
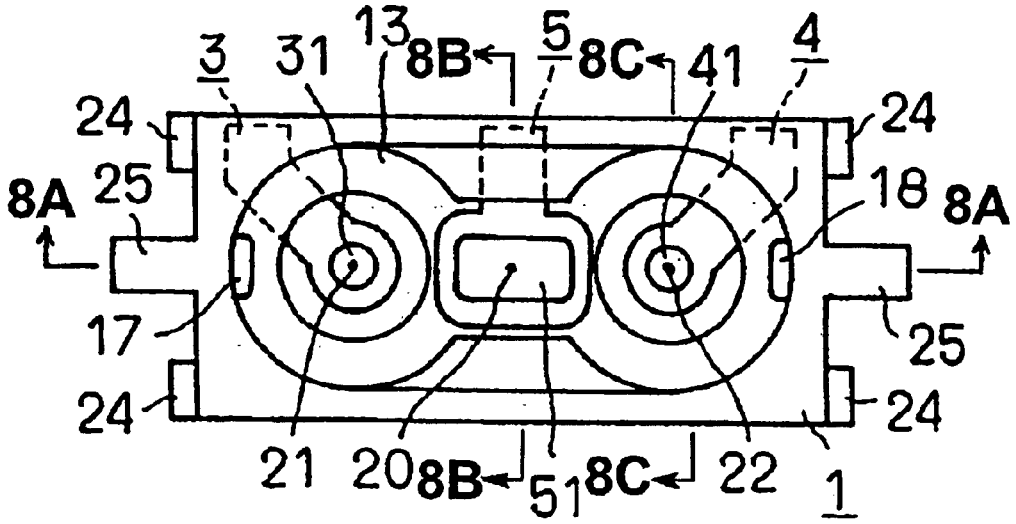
FIG. 5 is a top plan view of the housing 1 shown in FIG. 1A to FIG. 4.
Figure 6:
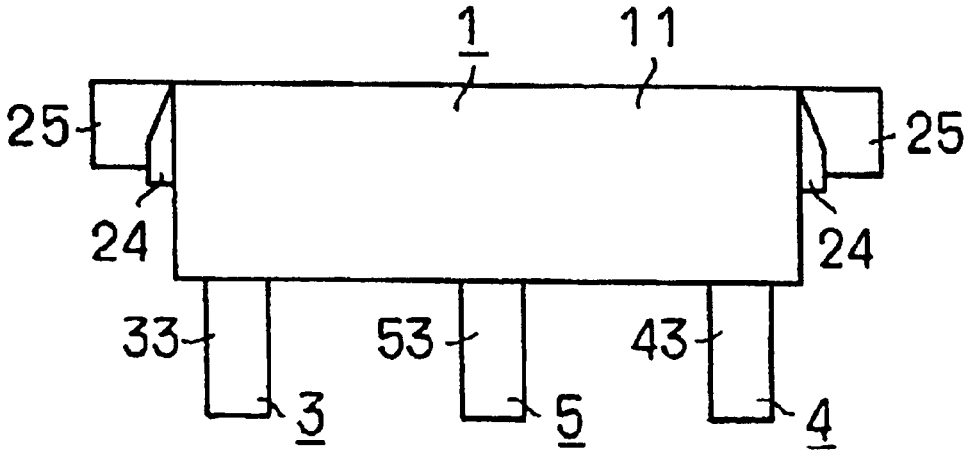
FIG. 6 is a front view of FIG. 5.

Similarly, the inner bottom face of the second accommodating recess 15 includes a circular center, an annular surround, and a second step 18 formed to a portion of the surround on the opposite side from the communicating recess 16 (right side in FIG. 5). A peripheral portion of the second plate member 7 abuts second step 18.

The inner bottom face of the communicating recess 16 includes a substantially square center and a trapezoidal surround, which is continuous with two opposite sides (upper and lower sides in FIG. 5) of the center. The center has substantially the same height as the surrounds of the first and second accommodating recesses 14, 15, while the surround is formed slightly higher than the center.

The center axis 20 of the communicating recess 16, and the center axes 21, 22 of the first and second accommodating recesses 14, 15, which are vertical to the plate face of the bottom plate 11, are equally spaced from each other.

The side plates 12 of the housing 1 are formed, on an outer face thereof, with locking protrusions 24 for securing the cover 9, and stoppers 25 for retaining the housing 1 onto the printed circuit board 10 when the switch is mounted in a recess 10*a* in the printed circuit board 10.

The first, second, and third terminals 3, 4, 5 are integrally formed in the bottom plate 11 of the housing 1 when fabricating the housing 1. For example, the housing 1 is formed by resin injection molding, and the first, second, and third terminals 3, 4, 5, which are press-formed from conductive metal plate, are placed in the mold set before injecting or setting the resin. One end of the third terminal 5 is formed with a contact point 51, while the other end thereof is formed with a connecting portion 53, with an exposed portion 52 formed therebetween.

The center of the contact point 51 coincides with the vertical axis 20 of the communicating recess 16. The contact point 51 is exposed from the surrounding bottom face at the center of the communicating recess 16. The top face of the contact point 51 is at substantially the same height as the top faces of the first and second steps 17, 18.

The exposed portion 52 is drawn outside from around a mid point of one longer side of the bottom plate 11, bent along the outer contour of the bottom plate 11, and extended parallel to the shorter sides of the bottom plate 11 as far as to the middle of the outer face of the bottom plate 11.

The connecting portion 53 protrudes outward from the distal end of the exposed portion 52 vertically to the outer face of the bottom plate 11.

The first and second terminals 3, 4 are similarly formed with contact points 31, 41 at one end, and exposed portions 32, 42 and connecting portions 33, 43 at the other end.

The centers of the contact points 31, 41 coincide with the vertical axes 21, 22 of the first and second accommodating recesses 14, 15. The contact points 31, 41 are exposed from the surrounding bottom face at respective centers of the accommodating recesses 14, 15. The top faces of the contact points 31, 41 are slightly higher than their surrounds and slightly lower than the top faces of the first and second steps 17, 18.

The exposed portions 32, 42 are drawn outside near both ends of one longer side of the bottom plate 11, bent along the outer contour of the bottom plate 11, and extended substantially parallel to the exposed portion 52 of the third terminal 5.

The connecting portions 33, 43 protrude outward from the distal ends of the exposed portions 32, 42 vertically to the outer face of the bottom plate 11.

The first plate member 6 is obtained by punching and drawing from a resilient, conductive metal plate. It has a domed disk-like shape bulging away from the inner bottom face of the first accommodating recess 14 as shown in FIGS. 1A and 8A and is placed inside the recess 14.

The second plate member 7 is also obtained by punching and drawing from a resilient, conductive metal plate to have a domed disk-like shape similar to the first plate member 6, and is placed inside the second accommodating recess 15.

The key top 8 is provided for pressing the first and second plate members 6, 7 to cause two step resilient deformation; it is made up of an oval plate-like main body 81, a pillar-like operating portion 82 protruding from the top face of the main body 81, and pillar-like pressing portions 83, 84 protruding from the bottom face of the main body 81, as shown in FIG. 9.

The center axes 86, 87 of the first and second pressing portions 83, 84, which are vertical to the plate face of the main body 81, are equally spaced from the center vertical axis 85 of the main body 81, and the center vertical axis 88 of the operating portion 82 is located in between the axes 86, 85 of the first pressing portion 83 and the main body 81, respectively.

Figure 10A:
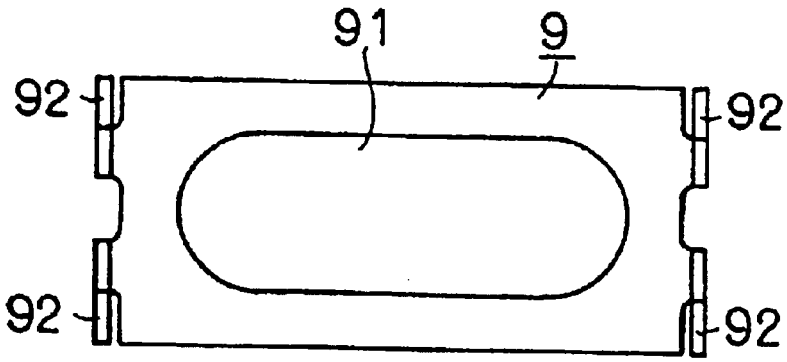
FIG. 10A is a top plan view illustrating the cover 9 shown in FIG. 1 to FIG. 4.
Figure 10B:
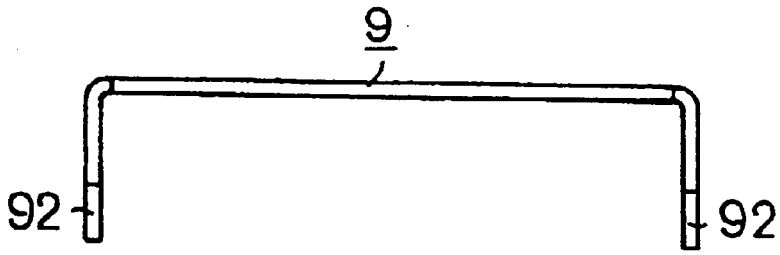
FIG. 10B is a front view of the cover shown in FIG. 1 to FIG. 4.
Figure 10C:
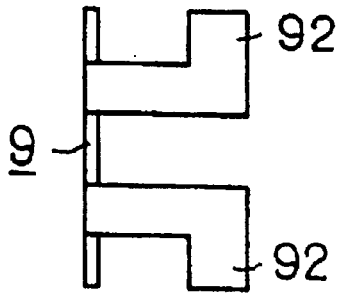
FIG. 10C is a right side view of FIG. 10A.

The cover 9 is fixed to the housing 1 to close the open end of the cavity 13. It has a rectangular shape conforming to the periphery of the housing 1 as shown in FIG. 10A, with a hole 91 for allowing the operating portion 82 of the key top 8 to protrude therethrough and to move up and down. Locking springs 92 are provided at the outer periphery and are press-fitted to the locking protrusions 24 of the housing 1.

The double action push switch is assembled as follows:

(1) The first, second, and third terminals 3, 4, 5 are integrally formed with the bottom plate 11 of the housing 1 as shown in FIG. 5 to FIG. 8C at the time of fabricating the housing 1.

(2) The first and second plate members 6, 7 are then mounted at respective locations inside the cavity 13 of the housing 1; the first plate member 6 is placed in the first accommodating recess 14, and the second plate member 7 is placed in the second accommodating recess 15.

The vertical center axis of the first plate member 6 is made-to coincide with the vertical axis 21 of the first accommodating recess 14, and the vertical center axis of the second plate member 7 coincides with the vertical axis 22 of the second accommodating recess 15. Peripheral portions of the first plate member 6 abut the first step 17 and the contact point 51 of the third terminal 5, while its center top faces the contact point 31 of the first terminal 3 with a certain spacing between the center top of the first plate member 6 and the contact point 31 of the first terminal 3. Peripheral portions of the second plate member 7 abut the second step 18 and the contact point 51 of the third terminal 5, while its center top faces the contact point 41 of the second terminal 4 with a certain spacing between the center top of the second plate member 7 and the contact point 41 of the second terminal 4.

(3) The main body 81 of the key top 8 is accommodated in the cavity 13 of the housing 1, and the cover 9 is placed on top of it such that the operating portion 82 protrudes from the hole 91. The locking springs 92 of the cover 9 are press-fitted to the locking protrusions 24 on the housing 1 to complete the assembly. The resultant switch appears as shown in FIG. 1A to FIG. 4. When placing the key top 8 in the cavity 13, the aforementioned vertical axes 85, 86, 87 of the main body 81 are made to coincide with the vertical axes 20, 21, 22 of the housing 1, respectively.

In this state, the first and second plate members 6, 7 are slightly deformed inside the first and second recesses 14, 15 because their center tops are pressed by the first and second pressing portions 83, 84 of the key top 8, and their peripheral portions are in stable contact with the contact point 51 of the third terminal 5 as shown in FIG. 1A.

Alternatively, the switch may have such a construction that, in this assembled state, the first and second pressing portions 83, 84 of the key top 8 merely make contact with the center tops of the first and second plate members 6, 7 with or without a damper therebetween, so as not to cause resilient deformation of the first and second plate members 6, 7, with their peripheral portions barely touching, or not touching at all, the contact point 51 of the third terminal 5. In this case, the first pressing action by the operating portion 82 of the key top 8 causes the center top and periphery of the first plate member 6 to touch the contact points 31, 51 of the first and third terminals 3, 5, and the second pressing action causes the center top and periphery of the second plate member 7 to touch the contact points 41, 51 of the second and third terminals 4, 5.

(4) The double action push switch thus assembled is mounted in the recess la of the printed circuit board 10 as shown in FIGS. 1B and 1C and FIG. 2 to FIG. 4, and the connecting portions 33, 43, 53 of the first, second, and third terminals 3, 4, 5 are connected by soldering to corresponding lands on the printed circuit board 10 so as to establish an electrical connection with a circuit pattern. The pressing direction of the operating portion 82 of the key top 8 is in parallel to the substrate face of the printed circuit board 10, i.e., the double action push switch is laterally installed.

Stoppers 25 on the housing 1 abut the substrate face at the edge of the recess 10*a* in the printed circuit board 10 and prevent the switch from coming off of the board. Thus, the mounting of the switch onto the printed circuit board 10 is readily carried out.

The switch operates as follows:

For ease of description, the operating loads or pressing loads of the first and second plate members 6, 7 are expressed as P1, P2, the distance between the vertical axes 86, 85 and vertical axes 85, 87 as L, the distance between the vertical axes 88, 85 as M (M<L), and pressing points of the first and second pressing portions 83, 84 on the first and second plate members 6, 7 as K1, K2, as indicated in FIG. 1A.

(1) When the pressing point K1 is acting as a fulcrum and moments upon the key top 8 are balanced, an operating load P3 applied to the operating portion 82 is expressed by the following equation 1:

$$P3=(2L\times P2)/(L-M) \quad (1).$$

When the pressing point K2 is acting as a fulcrum and moments upon the key top 8 are balanced, an operating load P4 applied to the operating portion 82 is expressed by the following equation 2:

$$P4=(2L\times P1)/(L+M) \quad (2).$$

(2) Because the first and second plate members 6, 7 are given the same load characteristics, P1 is equal to P2, hence P3 is larger than P4.

The operating load P3 corresponds to the force for inverting the second plate member 7, and the operating load P4 corresponds to the force for inverting the first plate member 6. Thus, when the operating portion 82 of the key top 8 is pushed, the first pressing portion 83 presses down the center top of the first plate member 6 and inverts the first plate member 6, thereby producing a clicking feeling, and causing the first plate member 6 to touch the contact point 31 of the first terminal 3. The first electrical connection is thereby achieved between the first and third terminals 3, 5.

When the operating portion 82 of the key top 8 is further pushed, the second pressing portion 84 presses down the center top of the second plate member 7 and inverts the second plate member 7, thereby producing a clicking feeling, and causing the second plate member 7 to touch the contact point 41 of the second terminal 4. The second electrical connection is thereby achieved between the first, second, and third terminals 3, 4, 5.

(3) When the operating portion 82 of the key top 8 is released from the pressing force, the first and second plate members 6, 7 push up the key top 8 by the resilient force of their own and return to the initial state shown in FIG. 1A, wherein their center tops are separated from the contact points 31, 41 of the first and second terminals 3, 4 and are electrically disconnected therefrom.

In the embodiment described above, the housing 1 is formed with the stoppers 25 which will abut the substrate face at the edge of the recess 10*a* in the printed circuit board 10 so as to facilitate the mounting of the housing 1 onto the board 10. Such stoppers can be omitted, because the present invention is obviously not limited to this arrangement and may be applied to a printed circuit board that is not formed with a recess 10*a*.

The above embodiment has shown a push switch that is laterally disposed on the printed circuit board 10 so that it has a small height, wherein the operating portion 82 is pressed substantially parallel to the substrate face of the printed circuit board 10. The connecting portions 33, 43, 53 of the first, second, and third terminals 3, 4, 5 are accordingly protruded in substantially the same direction as the pressing direction of the operating portion 82 of the key top 8. The present invention is not limited to this arrangement and may be applied to a vertically oriented push switch whose operating portion 82 is pressed vertically to the substrate face of the printed circuit board 10.

In the above embodiment, the vertical axis 88 of the operating portion 82 of the key top 8 is located between the vertical axes 86, 85, so that the first pressing force applied to the operating portion 82 causes inversion of the first plate member 6 and the second pressing force causes inversion of the second plate member 7. This arrangement can be reversed, so that the vertical axis 88 of the operating portion 82 of the key top 8 is located between the vertical axes 85, 87, in which case the first pressing force applied to the operating portion 82 will cause inversion of the second plate member 7 and the second pressing force will cause inversion of the first plate member 6.

The above embodiment has shown one example in which the first and second plate members 6, 7 are given the same load characteristics and the operating portion 82 is formed at such a location that its vertical axis 88 is offset from the center vertical axis 85 of the key top 8. The present invention is not limited to this arrangement; the first and second plate members 6, 7 may have different load characteristics, and the operating portion 82 may be positioned so that its vertical axis 88 coincides with the center vertical axis 85 of the key top 8. Alternatively, with the first and second plate members 6, 7 having different load characteristics, the operating portion 82 may be formed at such a location that its vertical axis 88 is offset from the center vertical axis 85 of the key top 8, where the aforementioned respective operating loads P3, P4 on the operating portion 82 are not equal when the pressing points K1, K2 are acting as a fulcrum and moments on the key top 8 are balanced.

Next, a second embodiment of the present invention will be described with reference to FIGS. 11A and 11B.

Figure 11A:
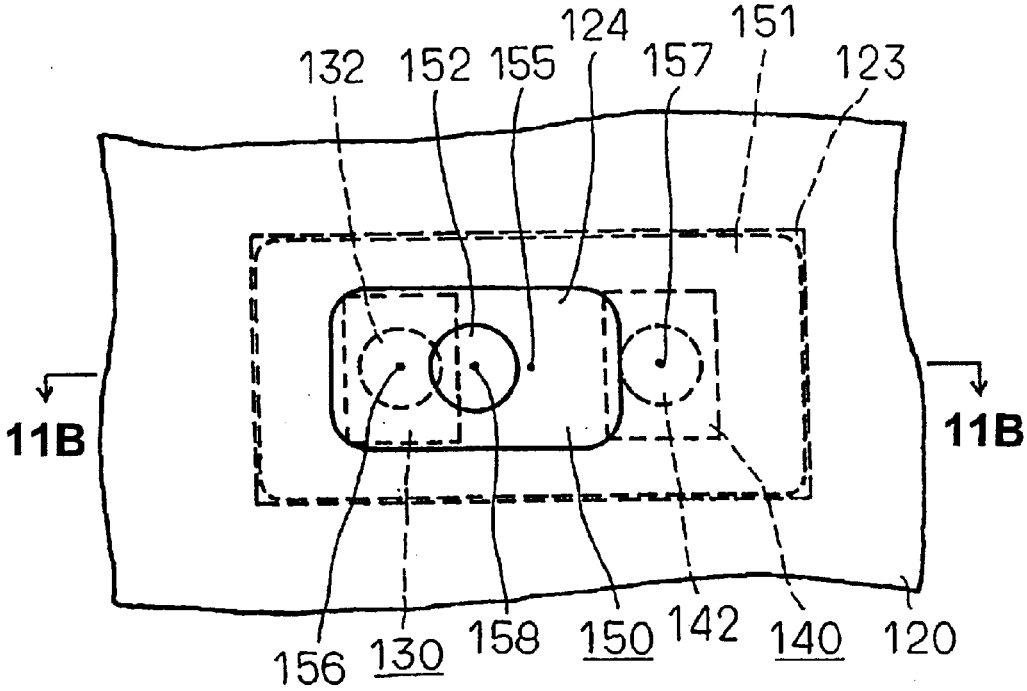
FIG. 11A is a top plan view of major parts of another embodiment of the present invention.
Figure 11B:
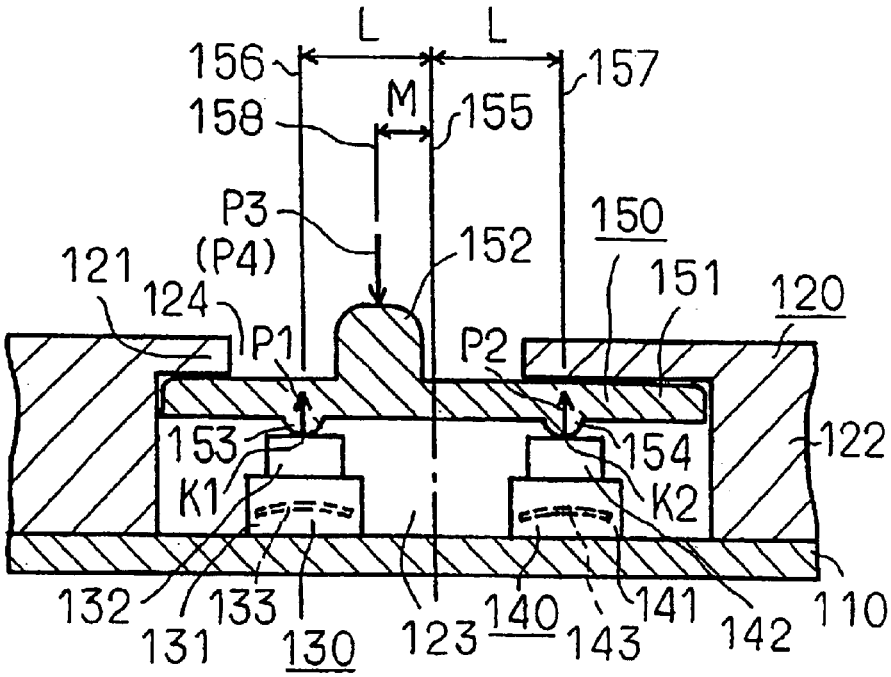
FIG. 11B is a cross section taken along the line 11B—11B of FIG. 11A.

Reference numerals 110, 120, 130, 140, and 150 in FIGS. 11A and 11B respectively represent a printed circuit board, a main case, a first push switch, a second push switch, and a key top.

The main case 120 consists of an upper plate 121 and side plates 122 integrally formed therewith from an insulating synthetic resin material. The upper plate 121 and side plates 122 together form a substantially cuboidal cavity 123 with an open top.

The main case 120 is fixed on an upper face of the printed circuit board 110. The top plate 121 is formed with a hole 124 communicating to the cavity 123.

The first and second push switches 130, 140 are fixed on the upper face of the printed circuit board 110 where the cavity 123 is formed. Connecting portions of the switches 130, 140 are respectively connected by soldering to corresponding lands on the printed circuit board 110 so as to establish an electrical connection with a circuit pattern.

The first and second push switches 130, 140 are respectively made up of first and second main bodies 131, 141 and first and second key tops 132, 142. The first and second main bodies 131, 141 each contain first and second plate members 133, 143 therein, which are given the same load characteristics.

Pressing down the first and second key tops 132, 142 of the first and second push switches 130, 140 causes an inversion of respective first and second plate members 133, 143, whereby a clicking feeling is obtained and switching is achieved.

The key top 150 includes a rectangular plate-like main body 151, a pillar-like operating portion 152 protruding from the top face of the main body 151, and substantially semi-spherical first and second pressing portions 153, 154 protruding from the bottom face of the main body 151. The operating portion 152 protrudes outside from the hole 124.

The center axes 156, 157 of the first and second pressing portions 153, 154 are vertical to the plate face of the main body 151 and are equally spaced from the center vertical axis 155 of the main body 151, and the center vertical axis 158 of the operating portion 152 is located in between the center axes 156, 155.

The switch shown in FIGS. 11A and 11B operates as follows:

For ease of description, the operating loads of the first and second plate members 133, 143 are expressed as P1, P2, the distance between the vertical axes 156, 155 and vertical axes 155, 157 as L, the distance between the vertical axes 158, 155 as M (M<L), and pressing points of the first and second pressing portions 153, 154 on the first and second switches 130, 140 as K1, K2, as indicated in FIG. 11B. The operating load. P3 applied to the operating portion 152, when the pressing point K1 is acting as a fulcrum and moments are balanced, is expressed by the aforementioned equation 1, and the operating load P4, when the pressing point K2 is acting as a fulcrum and moments are balanced, is expressed as the aforementioned equation 2, similarly to the embodiment shown in FIG. 1A to FIG. 10C.

Therefore, similarly to the previous embodiment, when the operating portion 152 of the key top 150 is pushed, the first pressing portion 153 presses the first key top 132 of the first push switch 130, thereby causing the first plate member 133 to invert and creating a clicking feeling. The first switch 130 is thereby turned on.

When the operating portion 152 of the key top 150 is further pushed, the second pressing portion 154 presses the second key top 142 of the second push switch 140, thereby causing the second plate member 143 to invert and creating a clicking feeling. The second switch 140 is thereby turned on.

When the operating portion 152 of the key top 150 is released from the pressing force, the first and second plate members 133, 143 push up the key top 150 via the first and second key tops 132, 142 by the resilient force of their own and return to the initial state shown in FIG. 11B, wherein both switches are turned off.

Figure 12A:
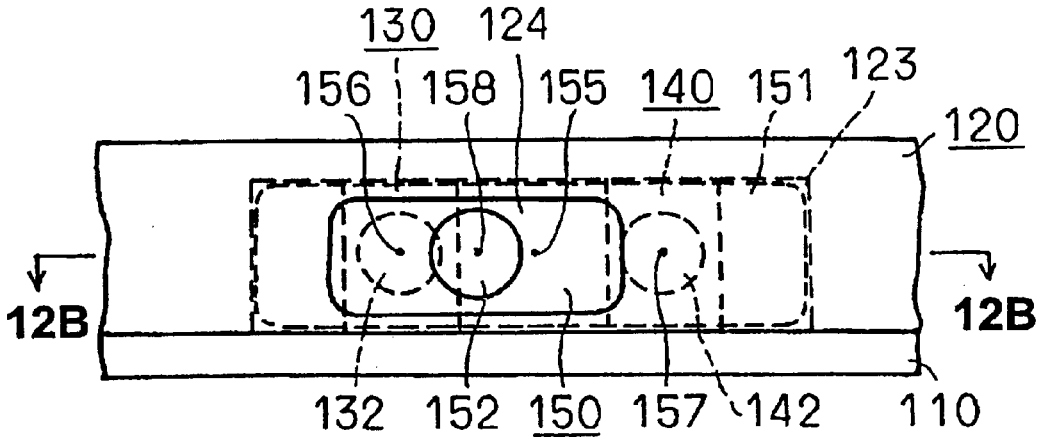
FIG. 12A is a top plan view of major parts of yet another embodiment of the present invention.
Figure 12B:
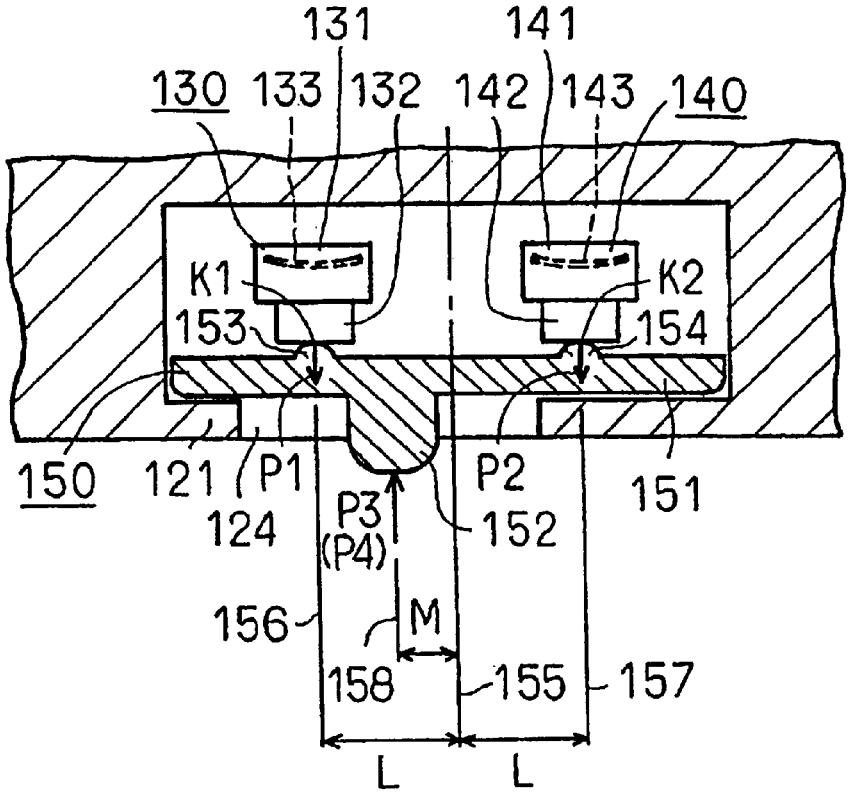
FIG. 12B is a cross section taken along the line 12B—12B of FIG. 12A.
Figure 13:
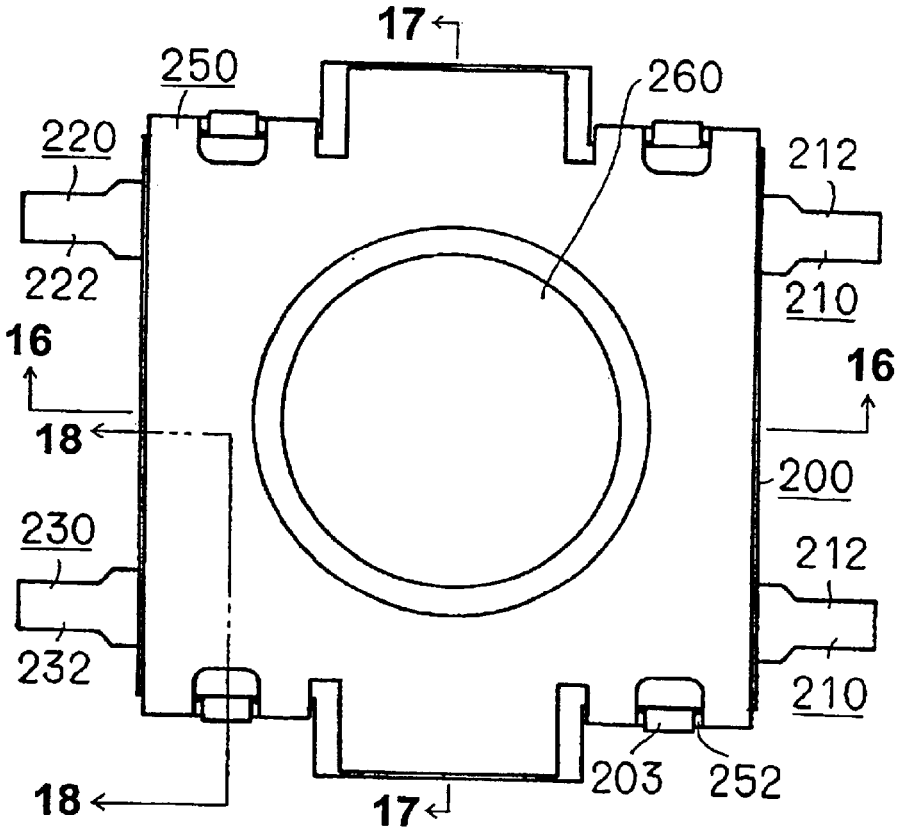
FIG. 13 PRIOR ART
FIG. 13 is a top plan view of a prior art example.
Figure 14:
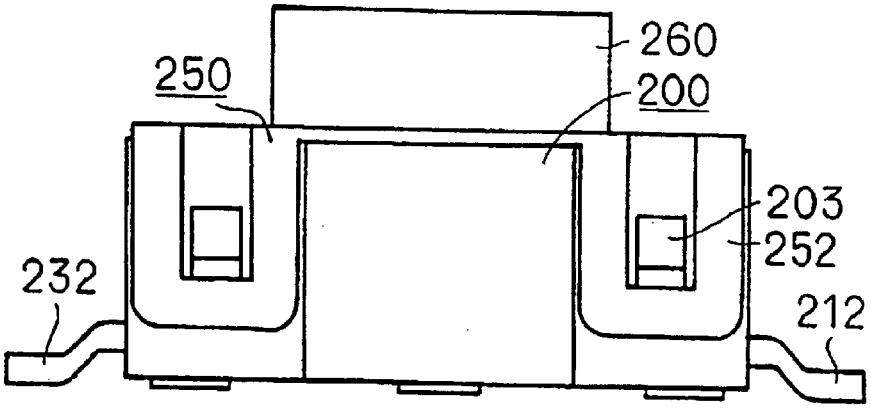
FIG. 14 PRIOR ART
FIG. 14 is a front view of FIG. 13.
Figure 17:
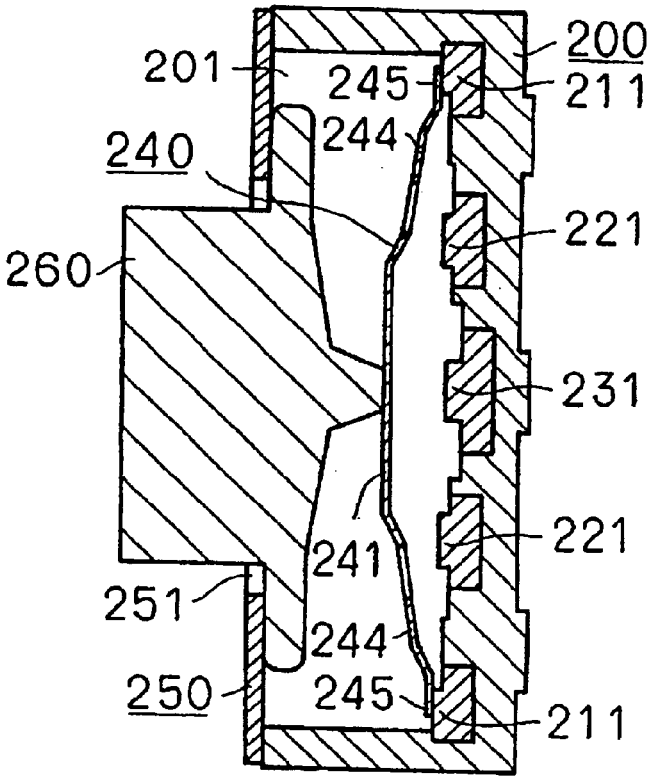
FIG. 17 PRIOR ART
FIG. 17 is a cross section taken along the line 17—17 of FIG. 13.
Figure 18:
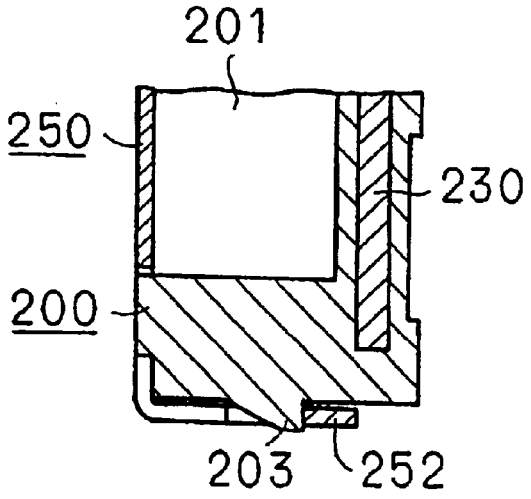
FIG. 18 PRIOR ART
FIG. 18 is a cross section taken along the line 18—18 of FIG. 13.
Figure 19A:
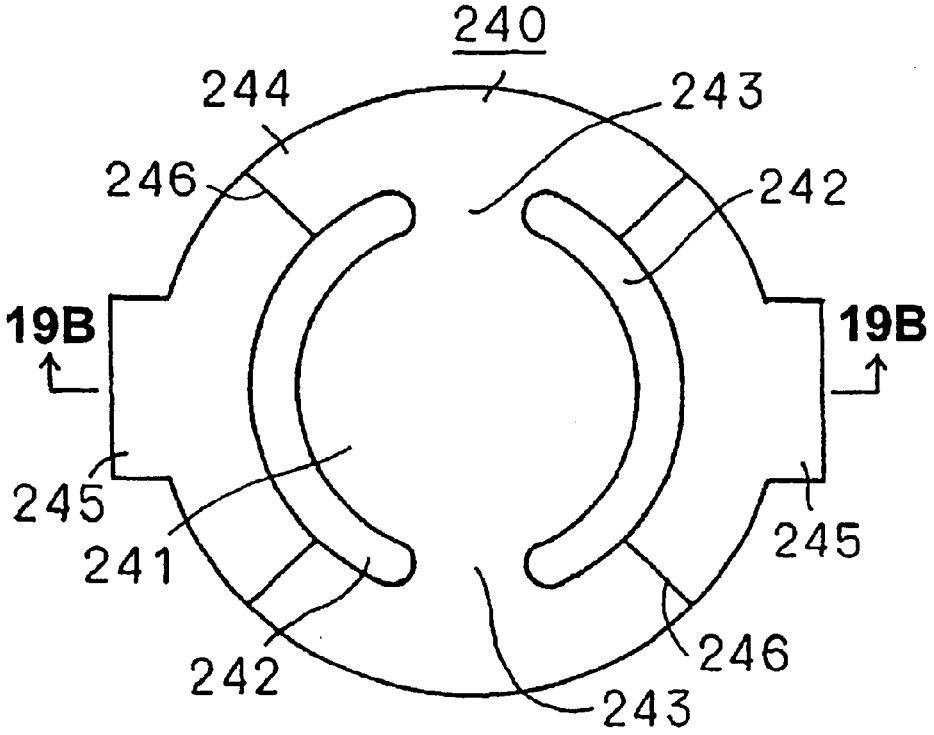
FIG. 19A PRIOR ART
FIG. 19A is a top plan view illustrating the plate member shown in FIG. 13 to FIG. 18.
Figure 19B:
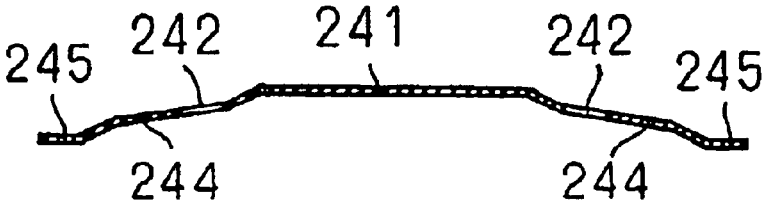
FIG. 19B PRIOR ART
FIG. 19B is a cross section taken along the line 19B—19B of FIG. 19A.
Figure 20:
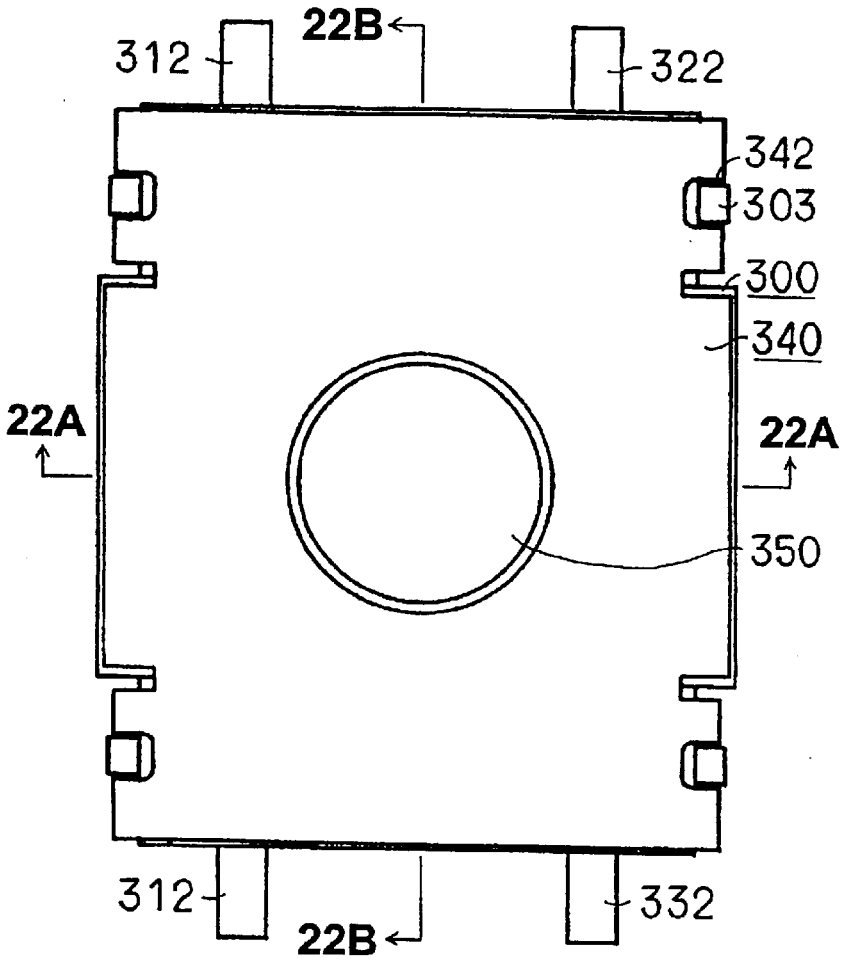
FIG. 20 PRIOR ART
FIG. 20 is a top plan view of a construction previously devised by the present inventors.
Figure 21:
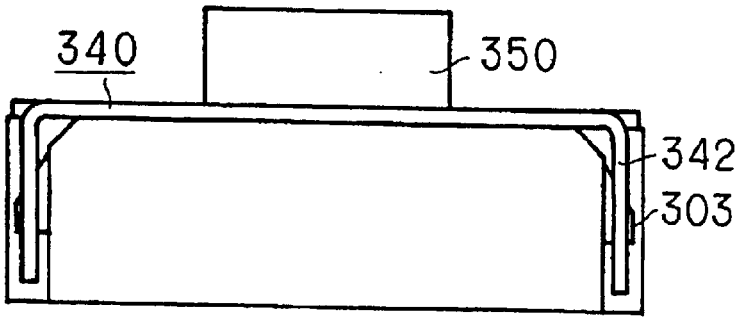
FIG. 21 PRIOR ART
FIG. 21 is a front view of FIG. 20.
Figure 23:
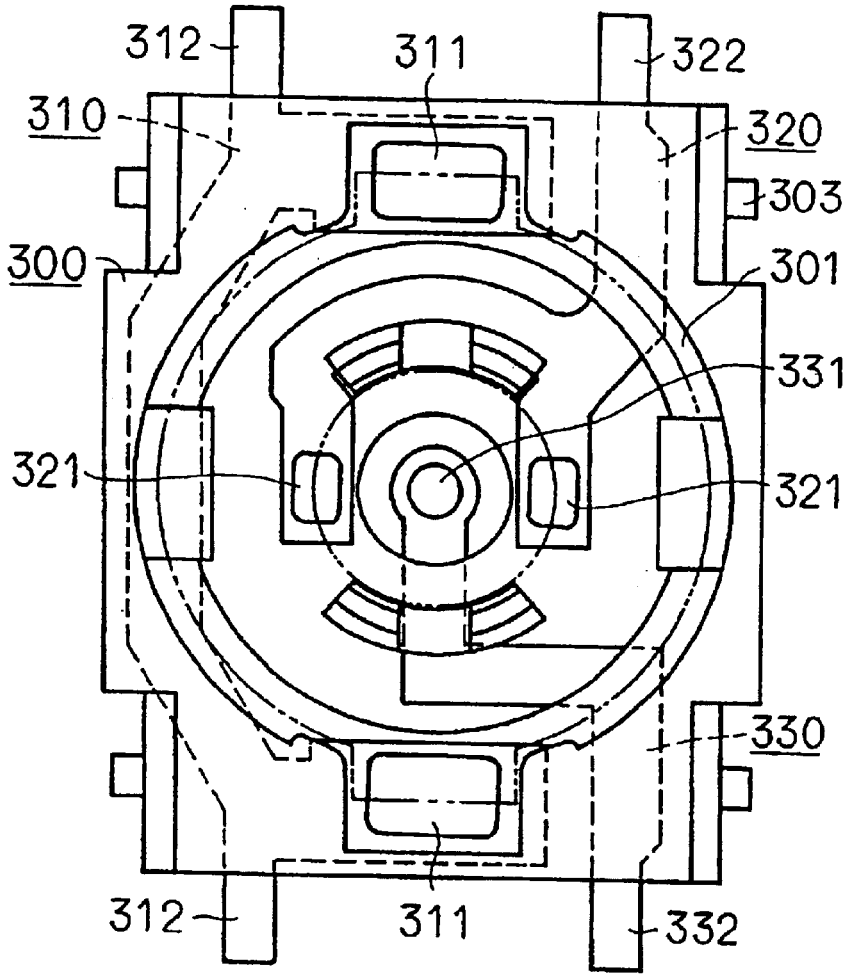
FIG. 23 PRIOR ART
FIG. 23 is a top plan view illustrating the housing 300 shown in FIG. 20 to FIG. 22B.
Figure 24:
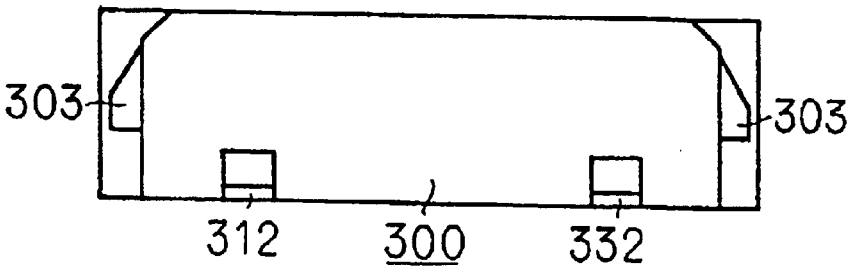
FIG. 24 PRIOR ART
FIG. 24 is a front view of FIG. 23.
Figure 25:
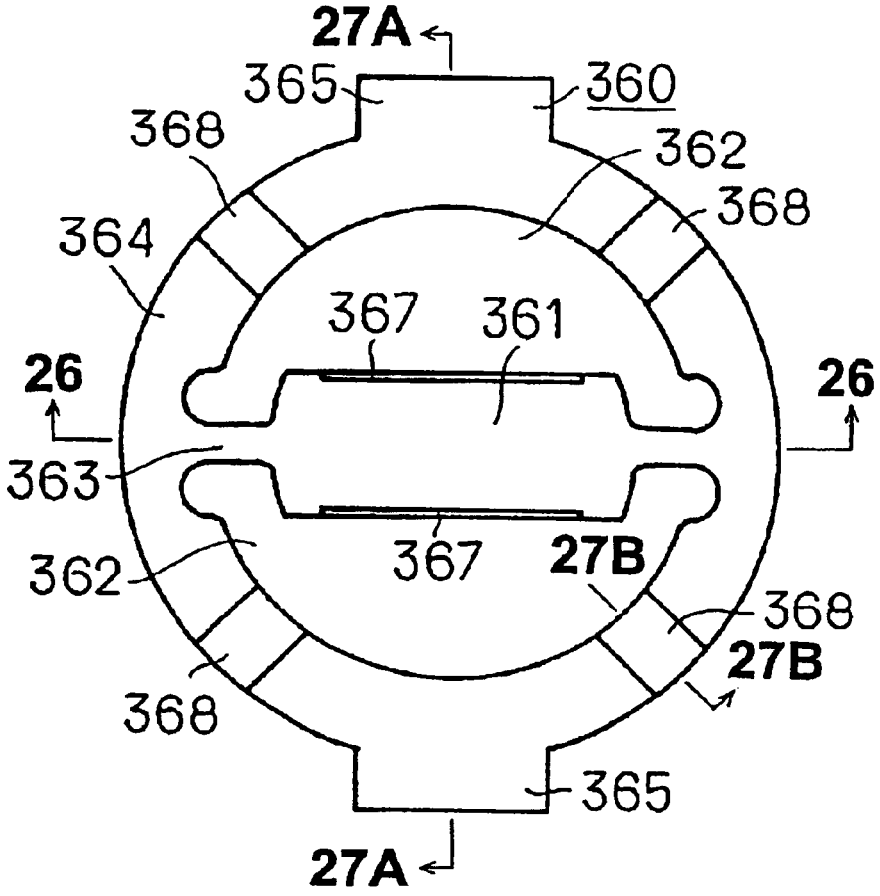
FIG. 25 PRIOR ART
FIG. 25 is a top plan view illustrating the first plate member 360 shown in FIG. 20 to FIG. 22B.
Figure 26:
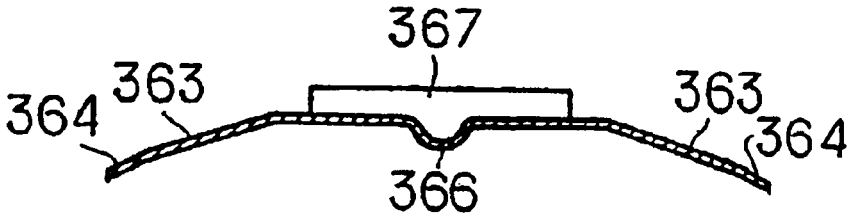
FIG. 26 PRIOR ART
FIG. 26 is a cross section taken along the line 26—26 of FIG. 25.

The example illustrated in FIGS. 11A and 11B is a vertically oriented push switch wherein the operating portion 152 of the key top 150 is pressed vertically to the substrate face of the printed circuit board 110. Accordingly, the first and second push switches 130, 140 are fixed to the printed circuit board 110 such that the bottoms of the first and second switch main bodies 131, 141 are in contact with the substrate face of the printed circuit board 110. This construction can also be applied to a laterally disposed push switch, wherein the operating portion 152 of the key top 150 is pressed parallel to the substrate face of the printed circuit board 110. FIGS. 12A and 12B illustrates the laterally oriented version of this switch, wherein the first and second push switches 130, 140 are fixed to the printed circuit board 110 such that the side faces of the first and second switch main bodies 131, 141 are in contact with the substrate face of the printed circuit board 110.

With the arrangement shown in FIGS. 12A and 12B, the height of the push switch from the substrate face of the printed circuit board 110 can be made smaller.

It should be noted that the elements shown in FIGS. 12A and 12B are given the same reference numerals as those of FIGS. 11A and 11B merely for ease of description, and they are actually different components from those shown in FIGS. 11A and 11B.

In the examples shown in FIGS. 11A to 12B, the vertical axis 158 of the operating portion 152 is located between the vertical axes 156, 155, so that the first pressing force applied to the operating portion 152 turns on the first push switch 130 and the second pressing force turns on the second push switch 140. This arrangement can be reversed, so that the vertical axis 158 of the operating portion 152 of the key top 150 is located between the vertical axes 155, 157, in which case the first pressing force applied to the operating portion 152 will turn on the second push switch 140 and the second pressing force will turn on the first push switch 130.

In the above examples shown in FIGS. 11A to 12B, the first and second plate members 133, 143 of the first and second push switches 130, 140 are given the same load characteristics and the operating portion 152 is formed at such a location that its vertical axis 158 is offset from the center vertical axis 155 of the key top 150. The present invention is not limited to this arrangement; the first and second plate members 133, 143 may have different load characteristics, and the operating portion 152 may be positioned so that its vertical axis coincides with the center vertical axis 155 of the key top 150. Alternatively, with the first and second plate members 133, 143 having different load characteristics, the operating portion 152 may be formed at such a location that its vertical axis 158 is offset from the center vertical axis 155 of the key top 150, where the aforementioned respective operating loads P3, P4 upon the operating portion 152 when the pressing points K1, K2 are acting as a fulcrum and moments on the key top 150 are balanced are not equal.

According to one aspect of the present invention, the plate member for achieving two step connection is made of two, first and second plate, members (6, 7) of dome-like form placed side by side in a cavity (13). The operating portion (82) is positioned on the key top (8) at such a location as to satisfy the condition of P3≠P4, P3 and P4 being respective operating loads upon the operating portion (82) when the pressing points (K1, K2) are acting as a fulcrum and moments on the key top (8) are balanced. Therefore, a pressing force first applied to the operating portion (82) causes inversion of the center of one of the first and second plate members (6, 7), and a pressing force applied next causes inversion of the center of the other one of the first and second plate members (6, 7). With such a construction, the push switch can have longer life, and there is more freedom in setting the load characteristics for each step of switching action. Furthermore, the switch occupies less mounting area on the printed circuit board (10). For example, when the first and second plate members (6, 7) both have an outer diameter of 2.3 mm, the outer dimensions of the switch shown in FIG. 2 will be 2.9 mm (W)×6.5 mm (L), hence smaller than the example shown in FIG. 22, whose second plate member (370) has also an outer diameter of 2.3 mm but whose dimensions are 7.8 mm×5.7 mm.

According to another aspect of the invention, with the first and second plate members (6, 7) having the same load characteristics, the point where the operating loads (P3, P4) are applied is set at a location offset from a mid point between the pressing points (K1, K2). Thereby, the first and second plate members (6, 7) are simply constructed.

According to another aspect of the invention, the first and second plate members (6, 7) may have different load characteristics, in which case the point where the operating loads (P3, P4) are applied is made to coincide with a mid point between the pressing points (K1, K2). Thereby, the position at which the operating portion (82) should be formed is readily determined.

Alternatively, according to another aspect of the invention, with the first and second plate members (6, 7) having different load characteristics, the point where the operating loads (P3, P4) are applied may be set at a location offset from a mid point between the pressing points (K1, K2). Thereby, there will be more freedom in setting respective load characteristics such as the clicking feeling for the first and second switching actions.

According to another aspect of the invention, the connecting portions (33, 43, 53) of the first, second, and third terminals (3, 4, 5) are protruded side by side from the housing (1) in a direction substantially the same as a direction in which the operating portion (82) of the key top (8) is pressed. Thereby, the housing 1 is laterally mounted onto the printed circuit board (10), i.e., the operating portion (82) of the key top (8) is pressed in a direction parallel to the substrate face of the printed circuit board (10). Thus, the switch has a lower height, e.g., 1.7 mm (see FIG. 2), from the substrate face than the prior art example which is 1.85 mm in height.

According to another aspect of the invention, the housing (1) includes stoppers (25) which will abut a substrate face at an edge portion of a recess (10*a*) formed in a printed circuit board (10) to which the housing (1) is mounted. Thereby, the housing (1) does not protrude largely from the edge of the printed circuit board (10), and the mounting of the housing (1) in a recess (10*a*) in the printed circuit board (10) is carried out easily.

According to another aspect of the present invention, the push switch includes a key top (150) and first and second push switches (130, 140) respectively having a dome-like first and second plate members (133, 143), and the operating portion (152) is positioned on the key top (150) at such a location as to satisfy the condition of P3≠P4, P3 and P4 being respective operating loads upon the operating portion (152) when the pressing points (K1, K2) are acting as a fulcrum and moments on the key top (150) are balanced. Therefore, a pressing force applied to the operating portion (152) causes an inversion of one of the first and second plate members (133, 143) for achieving a first electrical connection, and an inversion of the other one of the first and second plate members (133, 143) for achieving a second electrical connection. With such a construction, the push switch can have longer life, and there is more freedom in setting the load characteristics for each step of switching action. Furthermore, the switch occupies less mounting area on the printed circuit board.

According to another aspect of the invention, with the first and second plate members (133, 143) having the same load characteristics, the point where the operating loads (P3, P4) are applied is set at a location offset from a mid point between the pressing points (K1, K2). Thereby, the first and second push switches (130, 140) are simply constructed.

According to another aspect of the invention, the first and second plate members (133, 143) may have different load characteristics, in which case the point where the operating loads (P3, P4) are applied is made to coincide with a mid point between the pressing points (K1, K2). Thereby, the position at which the operating portion (152) should be formed is readily determined.

Alternatively, according to another aspect of the invention, with the first and second plate members (133, 143) having different load characteristics, the point where the operating loads are applied may be set at a location offset from a mid point between the pressing points (K1, K2). Thereby, there will be more freedom in setting respective load characteristics such as clicking feeling for the first and second switching actions.

According to another aspect of the invention, the first and second push switches (130, 140) are mounted on the printed circuit board (110) side by side such that the first and second key tops (132, 142) are pressed in a direction parallel to a substrate face of the printed circuit board (110). Thereby, the first and second push switches (130, 140) are mounted onto the printed circuit board (110) such that the operating portion (152) of the key top (150) is pressed in a direction parallel to the substrate face of the printed circuit board (110). The switch can thus have a reduced height from the substrate face.

What is claimed is:

1. A double action push switch comprising:

a housing formed with a cavity therein;

a first terminal, a second terminal, and a third terminal fixed in the housing, respectively having contact points exposed in an inner bottom face of the cavity;

a first plate member and a second plate member placed side by side inside the cavity, both having a domed shape with centers that bulge away from the inner bottom face of the cavity, said first plate member having a center and a peripheral portion respectively abutting the contact points of said first and third terminals, and said second plate member having a center and a peripheral portion respectively abutting the contact points of said second and third terminals; and a key top having an operating portion which is pressed for a double action switching operation and a first pressing portion and a second pressing portion for respectively pressing the centers of said first and second plate members for causing an inversion thereof, said operating portion being positioned at such a location that a first operating load on said operating portion, when a pressing point of said first pressing portion on said first plate member is acting as a fulcrum and moments on said key top are balanced, is not equal to a second operating load on said operating portion, when a pressing point of said second pressing portion on said second plate member is acting as a fulcrum and moments on said key top are balanced, wherein a first pressing force applied to said operating portion causes the inversion of the center of one of said first plate member and said second plate member for achieving a first electrical connection, and a second pressing force applied to said operating portion causes the inversion of the center of the other one of said first plate member and said second plate member for achieving a second electrical connection.

2. The double action push switch according to claim 1, wherein said first, second, and third terminals comprise respective connecting portions protruding side by side from said housing in a direction substantially the same as a direction in which said operating portion of the key top is pressed.

3. The double action push switch according to claim 2, wherein said housing comprises stoppers which abut a substrate face at an edge portion of a recess formed in a printed circuit board to which said housing is mounted.

4. The double action push switch according to claim 1, wherein said first plate member and said second plate member have identical load characteristics, and said first and second operating loads are applied on a point offset from a mid point between said pressing points of said first and second pressing portions on said first and second plate members.

5. The double action push switch according to claim 4, wherein said first, second, and third terminals comprise respective connecting portions protruding side by side from said housing in a direction substantially the same as a direction in which said operating portion of the key top is pressed.

6. The double action push switch according to claim 5, wherein said housing comprises stoppers which abut a substrate face at an edge portion of a recess formed in a printed circuit board to which said housing is mounted.

7. The double action push switch according to claim 1, wherein said first plate member and said second plate member have different load characteristics, and said first and second operating loads are applied on a point coinciding with a mid point between said pressing points of said first and second pressing portions on said first and second plate members.

8. The double action push switch according to claim 7, wherein said first, second, and third terminals comprise respective connecting portions protruding side by side from said housing in a direction substantially the same as a direction in which said operating portion of the key top is pressed.

9. The double action push switch according to claim 8, wherein said housing comprises stoppers which abut a substrate face at an edge portion of a recess formed in a printed circuit board to which said housing is mounted.

10. The double action push switch according to claim 1, wherein said first plate member and said second plate member have different load characteristics, and said first and second operating loads are applied on a point offset from a mid point between said pressing points of said first and second pressing portions on said first and second plate members.

11. The double action push switch according to claim 10, wherein said first, second, and third terminals comprise respective connecting portions protruding side by side from said housing in a direction substantially the same as a direction in which said operating portion of the key top is pressed.

12. The double action push switch according to claim 11, wherein said housing comprises stoppers which abut a substrate face at an edge portion of a recess formed in a printed circuit board to which said housing is mounted.

13. A double action push switch, comprising a first push switch and a second push switch mounted side by side on a printed circuit board, said first and second push switches respectively comprising a first key top and a second key top, and a first plate member and a second plate member of a domed shape with centers that bulge towards said first and second key tops; and an outer key top disposed opposite said first and second key tops, said outer key top comprising an operating portion protruded on one side of said outer key top and a first pressing portion and a second pressing portion protruded on the other side of said outer key top, wherein a pressing force applied to said operating portion of said outer key top causes said first and second pressing portions of said outer key top to press said first and second key tops, thereby causing an inversion of one of said first plate member and said second plate member for achieving a first electrical connection, and an inversion of the other one of said first plate member and said second plate member for achieving a second electrical connection, and said operating portion of said outer key top is positioned at such a location that a first operating load on said operating portion, when a pressing point of said first pressing portion on said first key top is acting as a fulcrum and moments on said outer key top are balanced, is not equal to a second operating load on said operating portion, when a pressing point of said second pressing portion on said second key top is acting as a fulcrum and moments on said outer key top are balanced.

14. The double action push switch according to claim 13, wherein said first and second push switches are mounted on the printed circuit board side by side such that said first and second key tops are pressed in a direction parallel to a substrate face of the printed circuit board.

15. The double action push switch according to claim 13, wherein said first plate member and said second plate member have identical load characteristics, and said first and second operating loads are applied on a point offset from a mid point between said pressing points of said first and second pressing portions on said first and second key tops.

16. The double action push switch according to claim 15, wherein said first and second push switches are mounted on the printed circuit board side by side such that said first and second key tops are pressed in a direction parallel to a substrate face of the printed circuit board.

17. The double action push switch according to claim 13, wherein said first plate member and said second plate member have different load characteristics, and said first and second operating loads are applied on a point coinciding with a mid point between said pressing points of said first and second pressing portions on said first and second key tops.

18. The double action push switch according to claim 17, wherein said first and second push switches are mounted on the printed circuit board side by side such that said first and second key tops are pressed in a direction parallel to a substrate face of the printed circuit board.

19. The double action push switch according to claim 13, wherein said first plate member and said second plate member have different load characteristics, and said first and second operating loads are applied on a point offset from a mid point between said pressing points of said first and second pressing portions on said first and second key tops.

20. The double action push switch according to claim 19, wherein said first and second push switches are mounted on the printed circuit board side by side such that said first and second key tops are pressed in a direction parallel to a substrate face of the printed circuit board.

* * * * *